US005435087A

United States Patent [19]

Karkar et al.

[11] Patent Number: 5,435,087

[45] Date of Patent: Jul. 25, 1995

[54] SOLAR POWERED DISPLAY DEVICE

[76] Inventors: Maurice N. Karkar, 26842 Calle Maria, Mission Viejo, Calif. 92692; Yaqub N. Karkar, 1015 McClellan, Wausau, Wis. 54403

[21] Appl. No.: 168,861

[22] Filed: Dec. 15, 1993

[51] Int. Cl.[6] ..... G09F 13/00

[52] U.S. Cl. ..... 40/575; 40/564

[58] Field of Search ..... 40/575, 576, 564, 541; 362/183, 812

[56] References Cited

U.S. PATENT DOCUMENTS

| | | | |
|---|---|---|---|
| D 320,815 | 10/1991 | Frost | D20/17 |
| 3,742,633 | 7/1970 | Palm | 40/576 |
| 4,843,525 | 6/1989 | Williams | 362/183 X |
| 4,903,172 | 2/1990 | Schoniger | 362/31 |
| 4,947,300 | 8/1990 | Wen | 362/183 |
| 4,989,124 | 1/1991 | Shappell | 362/183 |
| 4,994,941 | 2/1991 | Wen | 362/26 |
| 5,007,190 | 4/1991 | Shyu | 40/564 |
| 5,088,221 | 2/1992 | Bussiere et al. | 40/576 X |
| 5,101,329 | 3/1992 | Doyle | 362/183 |
| 5,107,637 | 4/1992 | Robbins | 362/183 X |
| 5,192,944 | 3/1993 | Otsuki et al. | 340/765 |

*Primary Examiner*—Kenneth J. Dorner
*Assistant Examiner*—Cassandra Davis
*Attorney, Agent, or Firm*—Stetina Brunda & Buyan

[57] ABSTRACT

A solar powered display device comprising a housing, a generally transparent cover, a solar panel disposed within the housing in planar parallel position with respect to the transparent cover, a battery disposed within the housing and electrically interconnected with the solar panel so as to facilitate charging of the battery via the solar panel, and an illuminator disposed within the housing so as to illuminate display indicia, the illuminator being in electrical communication with the solar panel and the battery so as to receive electrical power therefrom. The display indicia are formed upon plates removably disposed within the housing in planar parallel position with respect to the transparent cover, each plate preferably having a character or the like formed thereupon. A rack is configured to hold plates of a plurality of different sizes.

11 Claims, 2 Drawing Sheets

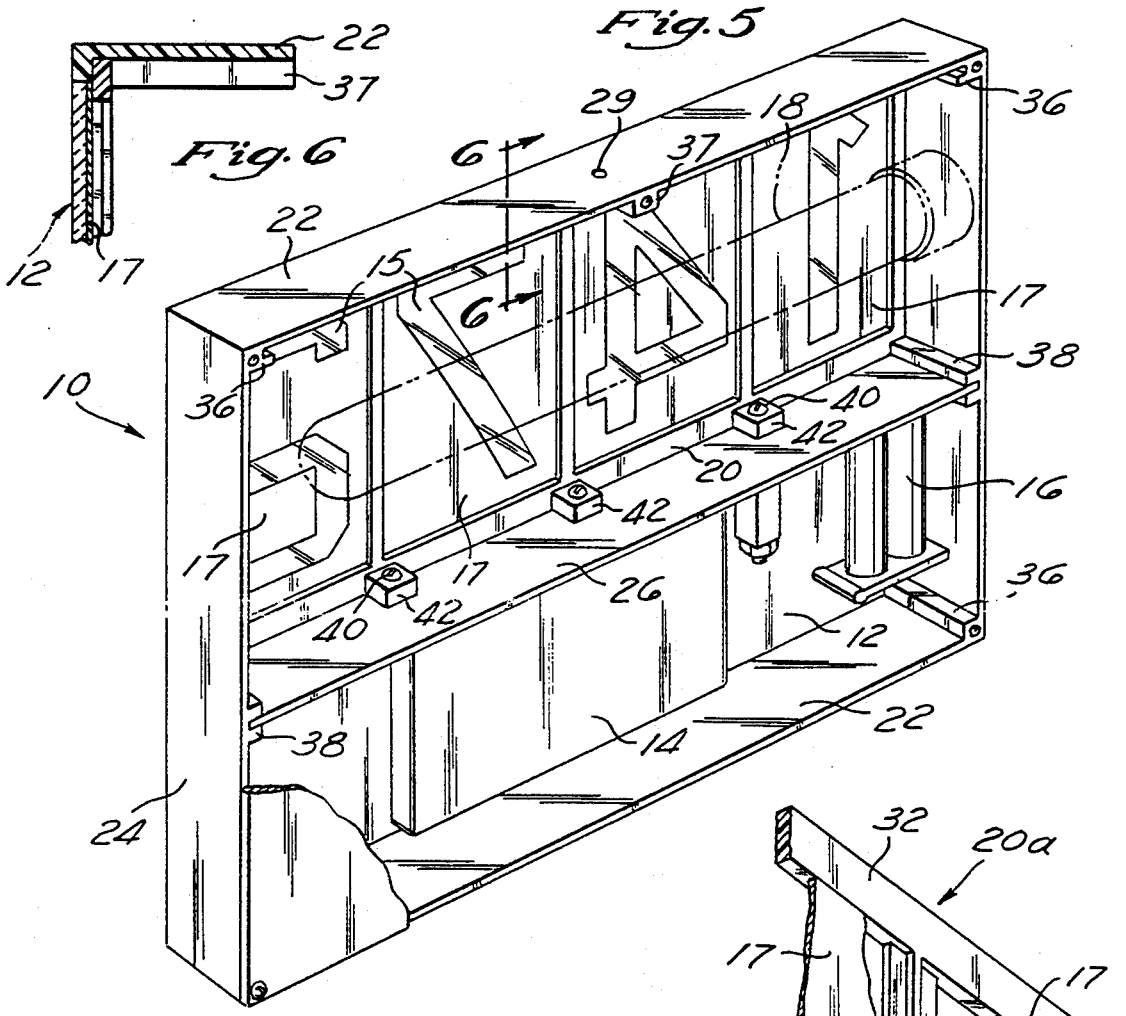
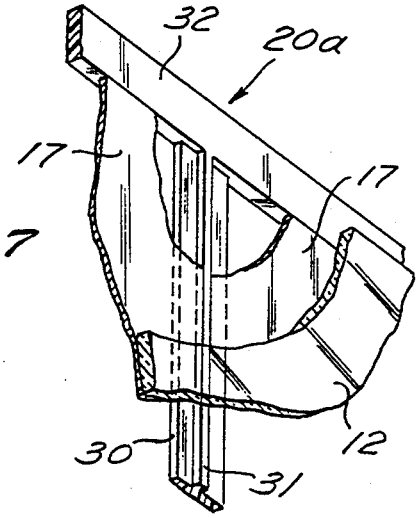
Fig. 7
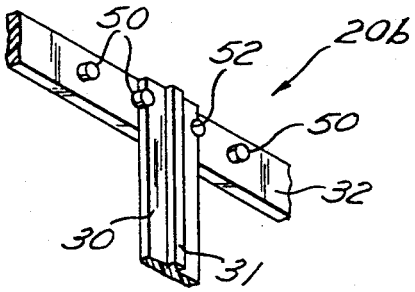
Fig. 8
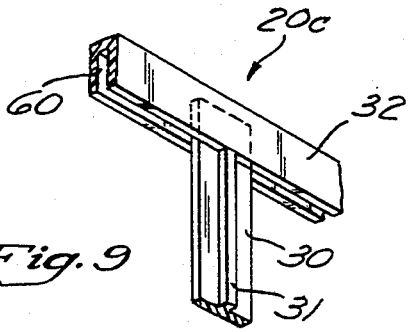
Fig. 9
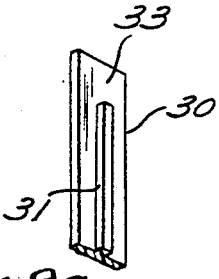
Fig. 9a

SOLAR POWERED DISPLAY DEVICE

FIELD OF THE INVENTION

The present invention relates generally illuminated displays and more particularly to a solar powered display device configured to accommodate a variety of different display indicia.

BACKGROUND OF THE INVENTION

Solar powered display devices such as those for use as signs and street number indicators are well known. Examples of such solar powered display devices are provided in U.S. Pat. No. 4,903,172, issued on Feb. 20, 1990 to Schoniger et al. and entitled DISPLAY CONSTRUCTION; U.S. Pat. No. 4,994,941, issued on Feb. 19, 1991 to Wen and entitled SIGN OF CHARACTER AND FIGURE; U.S. Pat. No. 5,007,190, issued on Apr. 16, 1991 to Shyu and entitled SOLARHOUSE-NUMBER INDICATING DEVICE; and U.S. Pat. No. 5,101,329, issued on Mar. 31, 1992 to Doyle and entitled REALTY SIGN LIGHTING AND DISPLAY ASSEMBLY.

Each of these patents disclose the use of a solar panel to collect sunlight and to convert the sunlight into electrical power for illuminating a desired display. A battery is used to store the electrical power provided by the solar panel so as to facilitate operation of the illumination means in the absence of sunlight, i.e., after dark, during overcast conditions, etc. Various illumination means including LEDs, incandescent lamps, and fluorescent lamps are disclosed.

Both U.S. Pat. No. 4,903,172 and U.S. Pat. No. 5,007,190 accommodate the use of interchangeable display indicia, such as those used to indicate house numbers, for example.

The use of such a solar powered display device to illuminate house numbers, for example, provides several advantages inherent to such solar powered display devices. Thus, the need for external wiring is eliminated. Also, frequent battery replacement is likewise eliminated. Various different indicia, i.e., different street numbers, may be utilized in conjunction with such contemporary solar powered display devices, thus increasing their flexibility and usefulness.

However, such contemporary solar powered display devices possess certain deficiencies which detract from their success in the marketplace. For example, contemporary solar power display devices do not readily accommodate different sizes of displays. The use of number plates allows a user to easily configure street number signs, for example, so as to display the desired number. This is accomplished by arranging the pre-printed number plates in the desired sequence and installing them within the display device. However, contemporary street number displays only accommodate a predetermined number of individual number plates, thereby limiting the number of digits which may be displayed.

Thus, one problem frequently encountered in the use of such contemporary devices is their inability to be utilized with display indicia, i.e., number plates, of different sizes so as to accommodate house numbers having varying numbers of digits. As will be recognized by one skilled in the art, the more digits contained in a particular house number, the smaller, i.e., thinner, each digit must be so as to fit within a given display device. Thus, each digit of a five-digit house number must be considerably smaller than each digit of a four-digit house number, if both house numbers are to be displayed with the same device.

In view of the foregoing, it would be desirable to provide a solar powered display device having interchangeable indicia formed upon a plurality of plates, wherein the size of the plates utilized may be varied by the user, as desired, to facilitate the display of various different numbers of plates.

SUMMARY OF THE INVENTION

The present invention specifically addresses and alleviates the above-mentioned deficiencies associated with the prior art. More particularly, the present invention comprises a solar powered display device comprising a housing, a generally transparent cover, a solar panel disposed within the housing in planar parallel position with respect to the transparent cover, a battery disposed within the housing and electrically interconnected with the solar panel so as to facilitate charging of the battery via the solar panel, and an illuminator disposed within the housing so as to illuminate the display indicia, the illuminator being in electrical communication with the solar panel and the battery so as to receive electrical power therefrom.

Display indicia are removably disposed within the housing in planar parallel position with respect to the transparent cover and comprise a plurality of separate plates, each plate preferably having a character or other indicia formed thereon.

A rack is removably mounted within the housing so as to position the plates in planar parallel position with respect to the cover. The rack is configured so as to accommodate a plurality of plates of different sizes, thereby increasing the flexibility and utility of the indicia displayed by the solar powered display device.

The rack comprises two generally parallel horizontal members configured to extend substantially across the cover and a plurality of vertical members extending intermediate the horizontal members and configured to capture the plates intermediate selected pairs thereof. The vertical members comprise tracks for receiving and holding the plates by the edges thereof.

In a first alternative configuration of the rack, the vertical members are configured so as to define a plurality of different spacings such that they accommodate a corresponding plurality of different sizes of plates. Selected ones of the vertical members are removable so as to define the desired spacing between remaining ones of the vertical members. Thus, the user merely selects those pairs of vertical members corresponding to the size of the plates to be held thereby and then removes any other vertical members, i.e., those defining unneeded spacings, so as to define a plurality of pairs of vertical members having the desired spacing. The rack is preferably configured such that the vertical members thereof are easily removable from the horizontal members thereof so as to facilitate removal of desired ones of the vertical members without tools. Thus, the vertical members may be removed by simply snapping them out of the rack. This is preferably facilitated by forming structurally weak areas, i.e., notches, at the tops and bottoms of the vertical members.

A groove is preferably formed along each side of each vertical member and configured so as to receive an edge portion of a plate so as to insure proper positioning of the plate and to insure adequate light sealing intermediate adjacent plates.

In a second alternative configuration of the rack, the vertical members are removably attachable to the horizontal members, preferably via a plurality of post pairs formed upon each horizontal member such that each end of a vertical member is capturable intermediate adjacent posts of a pair so as to attach a vertical member to the horizontal member. Complementary notches formed at each end of each vertical member insure correct and secure attachment thereof to the horizontal members by receiving the posts therein.

In a third alternative configuration of the rack, the distance between adjacent vertical members is adjustable. Each horizontal member preferably comprises a track within which one end of each vertical member is disposed such that the vertical members are slidable horizontally between the two parallel vertical members.

These, as well as other, advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 5 is an enlarged perspective view showing the rear of the solar powered display device of the present invention;

FIG. 6 is a cross-sectional side view taken along lines 6 of FIG. 5;

FIG. 7 is an enlarged fragmentary view showing portions, i.e., upper corners, of two plates captured at the intersection of a vertical member and horizontal member and showing the covering disposed in laminar juxtaposition therewith;

FIG. 8 is an enlarged perspective view showing the second alternative configuration of the rack utilizing a post pair to attach the vertical member to the horizontal member thereof;

FIG. 9 is an enlarged perspective view of the third alternative configuration of the rack wherein the vertical member is horizontally slidable along a track formed within each horizontal member to facilitate adjustment of the spacing of adjacent vertical members; and FIG. 9*a* is a perspective view of the upper end of the vertical member of FIG. 9, showing the grooves formed therein for receiving edge portions of the plates.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Although the present invention is described and illustrated as a street number indicator, those skilled in the art will recognize that various different types of displays are likewise suitable for use in the present invention. As such, illustration and description of the present invention as a street number indicator is by way of example only, and not by way of limitation and numerous other usages, such as vehicular license plate displays, specialized advertising displays, and general visual displays, are specifically contemplated herein.

Figure 1:
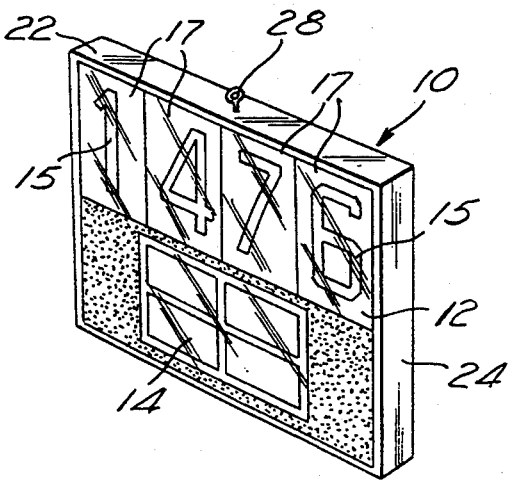
FIG. 1 is a perspective view showing the front of the solar powered display device of the present invention.
Figure 2:
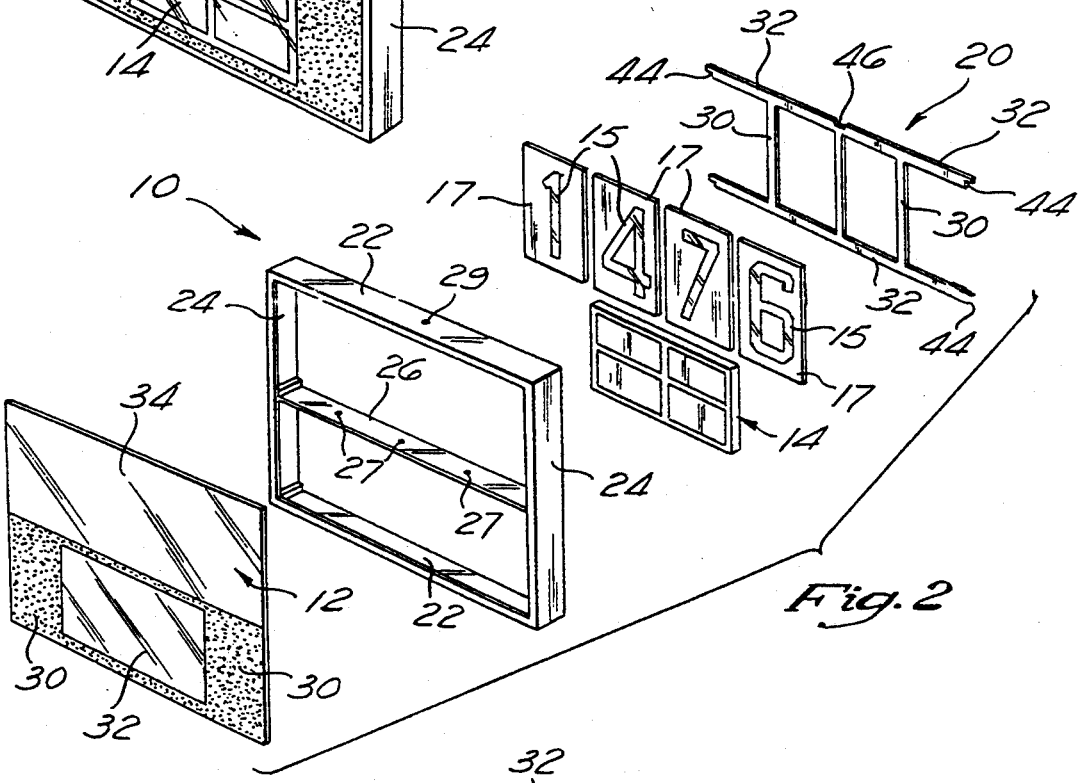
FIG. 2 is an exploded perspective view of the solar powered display device of FIG. 1.

The solar powered display device of the present invention as illustrated in FIGS. 1–9*a* of the drawings which depict a presently preferred embodiment of the invention. Referring now to FIGS. 1 and 2, the solar powered display device is comprised generally of a housing 10, a generally transparent cover 12, and a solar panel 14 disposed within said housing in planar parallel position with respect to said transparent cover 12.

At least one battery 16 (FIG. 5) is disposed within the housing and is electrically interconnected with the solar panel 14 so as to facilitate charging of the battery 16 via the solar panel 14. An illuminator 18 (FIG. 5) is disposed within the housing 10 so as to illuminate the display indicia 15. The illuminator 18 is in electrical communication with the solar panel 14 and the battery 16 so as to receive electrical power therefrom. The illuminator 18 may alternatively comprise LEDs, an incandescent light, or a fluorescent light. Those skilled in the art will recognize that various other means for illumination are likewise suitable.

Display indicia 15 are formed upon plates 17. The plates 17 are formed of a non-opaque material such that the indicia are illuminated by the illuminator 18.

A rack 20 is removably mountable within the housing 10 so as to position the plates 17 in laminar juxtaposition to the cover 12. The rack is configured so as to accommodate a plurality of plates of different sizes, thereby increasing the flexibility and utility of the present invention. At least one battery 16 is disposed within the housing and is electrically interconnected with the solar panel 14 so as to facilitate charging of the battery 16 via the solar panel 14 and operation of the illuminator 18. Those skilled in the art will recognize that various circuits for facilitating charging of the batteries 16 via the solar panel 14, and operation of the illuminator 18 from either the battery 16 or the solar panel 14 are suitable.

The housing 10 is preferably formed in the configuration of a rectangular frame having a front opening closed by the generally transparent cover 12 and a rear opening similarly closed by an opaque cover. Those skilled in the art will recognize that the rear cover may similarly be generally transparent, particularly when it is desired that the present invention provide a solar powered display device which is to be viewed from both sides thereof.

The housing 10 preferably comprises two horizontal members 22 and two vertical members 24 interconnected so as to define a generally rectangular frame. A horizontal interior member 26 bisects the generally rectangular frame and interconnects the two vertical members 24. The interior member 26 preferably separates the interior of the housing 10 into an upper portion within which the plates 17, rack 20, and the illuminator 18 are disposed and a lower portion within which the solar panel 14 and battery 16 are disposed. Those skilled in the art will recognize that various other configurations are likewise suitable.

The housing, including the horizontal members 22, vertical members 24, and the interior member 26 is preferably molded as an integral unit from a durable plastic material. Those skilled in the art will recognize that various other materials, i.e., metal, wood, etc., are likewise suitable.

An eyelet 28 is formed upon the upper horizontal member 22 and is preferably attached to the upper horizontal member 22 via threading into aperture 29 at approximately the center of the upper surface thereof. The eyelet 28 facilitates hanging of the solar powered display device of the present invention, as desired.

The cover 12 preferably comprises a mask or opaque portion 30 which prohibits viewing of the inside of the housing 10 and defines a solar panel window 32 and a display window 34. The plates 17 are disposed immediately behind and in planar parallel position with respect to the display window 34 such that the indicia 15 formed upon the plates 17 is visible therethrough. Similarly, the solar panel 14 is disposed immediately behind and in planar parallel position with respect to the solar panel window 32 such that sunlight may readily be received thereby.

Figure 3:
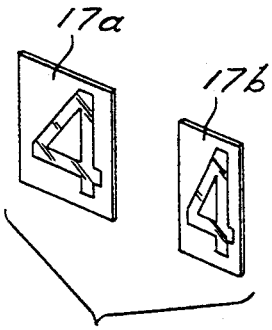
FIG. 3 is an enlarged perspective view showing two different sizes of plates.

Referring now to FIG. 3, both large plate 17*a* and small plate 17*b* may readily be accommodated by the solar powered display device of the present invention. More particularly, the rack 20 is configured so as to capture a plurality of different sizes of plates between itself and the cover 12. Three alternative configurations of the rack 20 are provided for so mounting the plates 17 within the solar powered display device of the present invention.

Referring now to FIGS. 5–7, the rack 20 is positioned within the upper portion of the housing 10 so as to capture a desired number and configuration of plates 17 between itself and the cover 12. Screws 40 attach the rack 20 through holes formed in bosses 42 extending therefrom to apertures 27 (FIG. 2) formed in the housing 10. Those skilled in the art will recognize that various other means for attaching the rack 20 to the housing 10 are likewise suitable. Notches 44 formed in the ends of the horizontal members 32 of the rack 20 and notch 46 formed at the center of the horizontal members 32 of the rack 20 provide clearance for bosses 36 formed in the corners of housing 10, bosses 38 formed at the middle of the vertical members 24 of the housing 10 and boss 37 formed at the center of top horizontal member 22, respectively.

Figure 4:
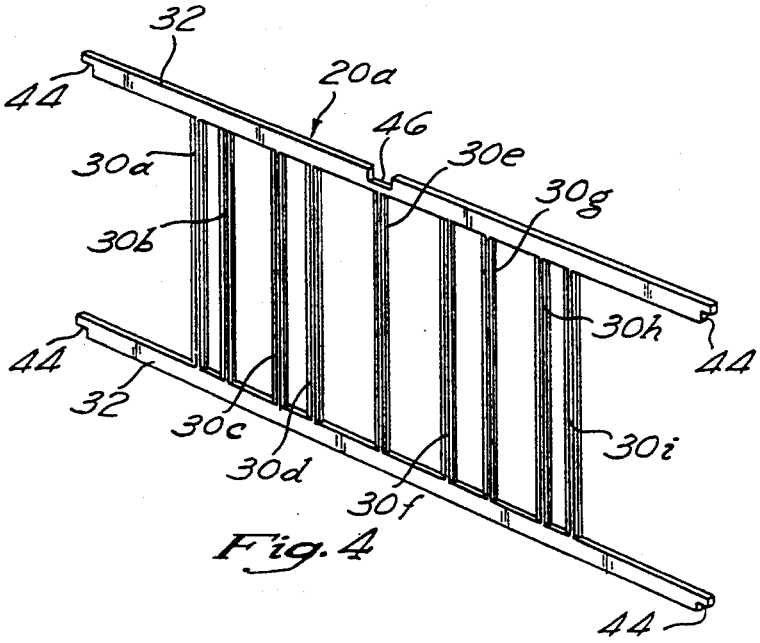
FIG. 4 is an enlarged perspective view of a first configuration of the rack wherein unused vertical members are broken away therefrom so as to define correctly spaced pairs of vertical members for the particular size of plates utilized.

Referring now to FIG. 4, in a first alternative embodiment of the rack 20*a* of the solar powered display device of the present invention, a plurality of vertical members 30*a–i* extend intermediate two parallel horizontal members 32. Each vertical member 30*a–i* is configured, i.e., notched, proximate its top and bottom ends, so as to be easily broken away from the rack such that the remaining vertical members are properly spaced so as to accommodate plates 17 of the desired size.

For example, if it is desired to display four of the larger plates 17*a*, then vertical members 13*b*, 13*c*, 13*e*, 13*g*, and 13*h* could be broken away such that five larger plates 17*a* could be accommodated by rack 20*a*. One plate 17*a* would be positioned outboard of vertical member 30*a* and another plate 17*a* positioned outboard of vertical member 30*i*. The three remaining plates 17*a* would be positioned intermediate remaining adjacent pairs of vertical members 30*a*–30*d*, 30*d*–30*f*, and 30*f*–30*i*.

As a further example, in order accommodate six of the smaller plates 17*b*, vertical members 30*b*, 30*d*, 30*f*, and 30*h* would be removed from the rack 20*a* and the six smaller plates 17*b* positioned within the rack in a manner analogous to that described above. Those skilled in the art will recognize that various other such configurations of the rack utilizing removable vertical members are likewise suitable for accommodating various other numbers and sizes of plates 17.

Referring now to FIG. 8, a second alternative configuration of the rack 20*b* utilizes a plurality of pairs of posts 50 formed upon both the upper and lower horizontal members 32 such that the vertical members 30 are removably attachable to the horizontal members 32 by capturing the upper and lower ends of the vertical members 30 intermediate the adjacent posts 50 of each pair. Notches 52 are preferably formed at the upper and lower ends of each vertical member 30 for receiving the posts 50 and thereby assuring proper placement of the vertical members 30 upon the rack 20*b*. Those skilled in the art will recognize that a plurality of such posts 50 facilitate positioning of the vertical members 30 so as to define various spacing therebetween, as desired, in order to accommodate various sizes of plates 17.

Referring now to FIGS. 9 and 9*a*, a third alternative configuration of the rack 20*c* has tracks 60 formed in the upper and lower horizontal member 32 thereof for receiving the upper and lower ends of the vertical members 30 such that the vertical members 30 are free to slide horizontally intermediate the two horizontal members 32 so as to accommodate various sizes of plates 17.

With particular reference to FIG. 9*a*, the raised portion 31 of each vertical member 30 does not continue to the ends of the vertical member 30 as in the first and second alternative embodiments thereof, such that flats 33 are formed at the ends of the vertical member 30 and are configured for being received within the slots or tracks 60 of the horizontal members 32.

In all three alternative embodiments of the rack 20, each vertical member is configured so as to hold or maintain one edge of a plate 17 in position, preferably via a raised portion 31 (FIGS. 7–9*a*) defining a groove 34 at the intersection of the raised portion 31 and the surface of the vertical member 30. Further, the vertical members are specifically sized and configured to overlap the edges of adjacent plate 17 thereby preventing any light leakage between adjacent plates which would detract from the visual aesthetics of the display.

It is understood that the exemplary solar powered display device of the present invention described herein and shown in the drawings represents only a presently preferred embodiment thereof. Indeed, various modifications and additions may be made to such embodiment without departing from the spirit and scope of the invention. For example, those skilled in the art will recognize that the rack may comprise additional horizontal members and similarly comprise additional interconnecting vertical members so as to define more than one level of plates. Thus, not only the street number, for example, but also the family name may be displayed, e.g., below the street number. Also, various configurations other than rectangular are likewise suitable. For example, the housing may similarly be configured to be round, oval, square, triangular, or any other desired shape. Thus, these and other modifications and additions may be obvious to those skilled in the art and may be implemented to adapt the present invention for use in a variety of different applications.

What is claimed is:

1. A solar powered display device comprising:

a) a housing;

b) a generally transparent cover;

c) a solar panel disposed within said housing in planar parallel position with respect to said transparent cover;

d) a battery disposed within said housing and electrically interconnected with said solar panel so as to facilitate charging of said battery via said solar panel;

e) a plurality of plates having edges and display indicia formed thereon removably disposed within said housing in planar parallel position with respect to said transparent cover;

f) an illuminator disposed within said housing so as to illuminate said display indicia, said illuminator in electrical communication with said solar panel and said battery so as to receive electrical power therefrom; and g) a rack removably mountable within said housing so as to position said plates in planar parallel position with respect to said cover, said rack configured to accommodate plates of a plurality of different sizes.

2. The solar powered display device as recited in claim 1 wherein said rack comprises:

a) two spaced generally parallel horizontal members configured to extend substantially across said cover; and b) a plurality of vertical members having opposed ends extending intermediate said horizontal members and configured to capture said plates intermediate selected pairs thereof.

3. The solar powered display device as recited in claim 2 wherein said vertical members comprise grooves for receiving and holding said plates by the edges thereof.

4. The solar powered display device as recited in claim 2 wherein said plurality of vertical members comprise vertical members configured so as to define a plurality of different spacings such that they accommodate a corresponding plurality of different sizes of plates, selected ones of said vertical members being removable so as to define the desired spacing between remaining ones of the vertical members.

5. The solar powered display device as recited in claim 2 wherein said vertical members are removably attachable to said horizontal members.

6. The solar powered display device as recited in claim 5 wherein said horizontal members comprise a plurality of post pairs such that each end of a vertical member is capturable intermediate adjacent posts of a pair so as to attach a vertical member to the horizontal members.

7. The solar powered display device as recited in claim 2 wherein the spacing between adjacent vertical members is adjustable.

8. The solar powered display device as recited in claim 7 wherein said horizontal members comprise tracks within which said ends of said vertical members are disposed such that said vertical members are slidable horizontally.

9. The solar powered display device as recited in claim 2 wherein said plurality of vertical members are sized and configured to eliminate light leakage between adjacent ones of said plurality of plates.

10. The solar powered display device as recited in claim 1 wherein said generally transparent cover comprises an opaque portion so as to define a display window and a solar panel window thereon.

11. The solar powered display device as recited in claim 1 wherein said plates comprise alpha/numeric indicia formed thereon.

* * * * *